US008733267B2

(12) United States Patent
Chen

(10) Patent No.: US 8,733,267 B2
(45) Date of Patent: May 27, 2014

(54) TELESCOPIC SUBMARINE

(75) Inventor: Jiashan Chen, Changsha (CN)

(73) Assignee: Shanghai Zhijing Biological Technology Co., Ltd., Shanghai (CN)

( * ) Notice: Subject to any disclaimer, the term of this patent is extended or adjusted under 35 U.S.C. 154(b) by 0 days.

(21) Appl. No.: 13/701,456

(22) PCT Filed: May 30, 2011

(86) PCT No.: PCT/CN2011/074845

§ 371 (c)(1), (2), (4) Date: Nov. 30, 2012

(87) PCT Pub. No.: WO2011/150786

PCT Pub. Date: Dec. 8, 2011

(65) Prior Publication Data

US 2013/0074759 A1 Mar. 28, 2013

(30) Foreign Application Priority Data

May 31, 2010 (CN) ..... 2010 2 0209349 U

(51) Int. Cl.
*B63G 8/14* (2006.01)

(52) U.S. Cl.
USPC ..... 114/331; 114/312

(58) Field of Classification Search
USPC ..... 114/312, 330–333, 121, 124, 125
See application file for complete search history.

(56) References Cited

U.S. PATENT DOCUMENTS 4,932,350 A * 6/1990 Takimoto ..... 114/330

* cited by examiner

*Primary Examiner* — Edwin Swinehart

(57) ABSTRACT

A telescopic submarine includes: a front submarine unit (1), a rear submarine unit (2), and a lift tower (3). A ring-shaped piston (14) connected with the rear submarine unit (2) is in a hydrocylinder (7) connected with the front submarine unit (1). When the piston (14) is moved forward, a volume of the telescopic submarine is decreased, a specific gravity of the telescopic submarine is increased, and therefore the telescopic submarine dives into the water gradually. The telescopic submarine is able to surface via operating the horizontal rudder (20) to raise the telescopic submarine to a surface of the water, and then pumping the hydraulic oil (32) into the hydrocylinder (7) via the hydraulic pump (11) to drive the piston (14) to move backward. Therefore the volume of the telescopic submarine is increased, the specific gravity of the telescopic submarine is decreased, and the telescopic submarine surfaces.

4 Claims, 4 Drawing Sheets

TELESCOPIC SUBMARINE

CROSS REFERENCE OF RELATED APPLICATION

This is a U.S. National Stage under 35 U.S.C 371 of the International Application PCT/CN2011/074845, filed May 30, 2011, which claims priority under 35 U.S.C. 119(a-d) to CN 201020209349.3, filed May 31, 2010.

BACKGROUND OF THE PRESENT INVENTION

1. Field of Invention

The present invention relates to a ship product, and more particularly to a submarine able to sail on water or under the water, having a water-borne displacement and a submerged displacement equal to each other.

2. Description of Related Arts

According to records, an earliest submarine appeared during American Revolution. After 200 years' development, from an early manpower submarine to a diesel-electric submarine and a nuclear power submarine, the submarine has become an important part of a modern navy. However a diving principle of the submarine has not changed. The diving principle is that a specific gravity of the submarine is changed via inhaling or blowing out seawater, in such a manner that the submarine is able to dive or surface. Therefore all of the modern submarines have double-skin structures, wherein a pressure hull inside is a cylinder having high roundness, and personnel, equipments, etc. are all in the pressure hull. A nonpressure hull outside is in a shape having low water resistance, e.g. water-drop shapes, a water box between the two hulls controls the submarine to dive or surface, and the nonpressure hull is able to resist attacks of underwater ordnances, e.g. depth bombs, to some extent. As a tactics or strategic weapon, the modern submarine has developed well, but the submarine still has some disadvantages such as a low deadweight, a low tank capacity and a complicated structure. When the submarine is sailing under water, a submerged displacement is larger than a water-borne displacement, so the water resistance is increased. With a large tank of water added, an underwater mobility of the submarine is not good. Therefore, applications of the modern submarines are limited, and usually limited to an assault weapon.

SUMMARY OF THE PRESENT INVENTION

An object of the present invention is to provide a telescopic submarine, which is a submarine having a single-skin pressure hull structure, is usually a midget submarine, and is able to sail on water or under the water. A water-borne displacement of the telescopic submarine is equal to a submerged displacement of the telescopic submarine. The structure and operation of the telescopic submarine is simple. A tank capacity of the telescopic submarine is large, and a water resistance thereof when sailing under the water is low. Therefore, the telescopic submarine has a wide application.

A technical solution of the present invention is as following. A telescopic submarine comprises: a front submarine unit 1, a rear submarine unit 2 and a lift tower 3, wherein the front submarine unit 1 comprises a submarine bow 4, which is domed, a front submarine body 5, which is cylindrical, a first wedge-shaped keel 6 connected with a lower portion of the front submarine body 5, and a hydrocylinder 7, which is ring-shaped and connected with a rear end of the front submarine body 5, wherein a vertical section of the hydrocylinder 7 is in a shape of a stair 33, a spacing ring 8 is provided in an end portion of the hydrocylinder 7, the hydrocylinder 7 is connected with a controlling valve 10 and a hydraulic pump 11 via a pipeline 9, and the controlling valve 10 and the hydraulic pump 11 are respectively connected with a hydraulic oil tank 12, and the rear submarine unit 2 comprises a rear submarine body 13, which is cylindrical, a piston 14, which is ring-shaped and connected with a front end of the rear submarine body 13, a submarine stern 15, which is cone-shaped and connected with a rear end of the rear submarine body 13, and a second wedge-shaped keel 16 connected with a lower portion of the rear submarine body 13, wherein a cross-sectional area of the second wedge-shaped keel 16 is smaller than a cross-sectional area of the first wedge-shaped keel 6, a first piston ring 17 is embedded in an outer surface of the piston 14, a second piston ring 18 is embedded in an inner surface of the piston 14, the piston 14 and the hydrocylinder 7 operate with each other slidingly, a propeller 19, a horizontal rudder 20 and a vertical rudder 21 are installed in the submarine stern 15, and an external thread sealing door 22 is installed on a top portion of the lift tower 3.

Working principles and operating methods of the present invention are explained in detail as followed.

The front submarine unit 1, the rear submarine unit 2 and the lift tower 3 are respectively manufactured, and outfitting is finished on a building slip. After the front submarine unit 1 and the rear submarine unit 2 are joined together, the telescopic submarine is able to take a shakedown cruise. When the telescopic submarine is sailing on the water, the piston 14 is located at the end portion of the hydrocylinder 7, namely near the spacing ring 8, in such a manner that a length of the telescopic submarine is largest, and a buoyancy is also largest. At this moment, the hydrocylinder 7 is full of hydraulic oil. A hydrocylinder body near the spacing ring 8 is thin, but an oil pressure in the hydrocylinder 7 is low when the telescopic submarine is sailing on the seawater, so a strength of the hydrocylinder body is not reduced. The telescopic submarine is able to dive via turning an external thread sealing door 22 to seal the telescopic submarine, and then opening the controlling valve 10, in such a manner that the hydraulic oil flows into the hydraulic oil tank 12 automatically, the piston 14 accordingly moves forward slowly to drive the rear submarine unit 2 to move forward, the second wedge-shaped keel 16 having smaller cross-sectional area is inserted into the first wedge-shaped keel 6 provided in the lower portion of the front submarine body 5, thus, a volume of the telescopic submarine decreases, a specific gravity of the telescopic submarine increases, and the telescopic submarine dives into the water gradually. If the piston 14 exceeds a thin part of the hydrocylinder 7 providing a minimum area above the water of the telescopic submarine, and the telescopic submarine doesn't dive into the water completely, the hydraulic oil continues to be discharged until the telescopic submarine dives into the water completely, then the portion of the telescopic submarine is adjusted via adjusting the hydraulic pump 11 and the controlling valve 10 until the telescopic submarine is in a zero gravity status, in such a manner that the telescopic submarine is able to dive into the water under driving of the propeller 19 and operation of the horizontal rudder 20. The telescopic submarine is able to surface via operating the horizontal rudder 20 to raise the telescopic submarine to a surface of the seawater, and then pumping the hydraulic oil into the hydrocylinder 7 via the hydraulic pump 11, in such a manner that the piston 14 moves backward, and the telescopic submarine surfaces silently. If the telescopic submarine has to surface quickly in an emergency, while the horizontal rudder 20 is operated, the hydraulic oil is pumped into the hydrocylinder 7 to drive the piston 14 to move backward. However, the piston 14 mustn't exceed a red line, that is to say the piston 14 is not allowed to be in a position of the thin part of the hydrocylinder 7 in deep water, otherwise, the telescopic submarine will have an accident.

In the deep water, a pressure in the hydrocylinder 7 is about 10 MPa. The hydrocylinder 7 is in a shape of a ring, which has a highest compressive strength, therefore when the hydrocylinder 7 has an enough thickness, the hydrocylinder 7 is safe. However, a diameter of the hydrocylinder 7 and a diameter of a submarine body are interrelated and approximately equal. When the diameter of the submarine body increases, the diameter of the hydrocylinder 7 will also increase, a radian will decrease. If the thickness of the hydrocylinder 7 doesn't change, the compressive strength of the hydrocylinder 7 will decrease. That's why the telescopic submarine could only be a medium or midget submarine.

No matter whether the telescopic submarine is with light load or heavy load, the telescopic submarine is able to sail under the water via adjusting a stroke of the piston 14. It means the telescopic submarine is still able to return under the water, after the telescopic submarine is unloaded.

In addition, there is a problem of navigability on the water. When the telescopic submarine is sailing on the water, in a case that the front submarine unit 1 and the rear submarine unit 2 are respectively on two wave crests at a same time, will gravity break off the telescopic submarine at a joint between the front submarine unit 1 and the rear submarine unit 2? The joint is located in a position of the ring-shaped hydrocylinder 7, which has the highest compressive strength of the whole telescopic submarine, and the wedge-shaped keels aid in lifting, so the telescopic submarine will not be broken off in a middle.

A plurality of watertight windows are respectively provided at two sides of the front submarine body 5 and the rear submarine body 13, and the watertight windows are made of laminated glasses.

The telescopic submarine utilizes electric driving or diesel-electric driving. When the telescopic submarine is driven by a diesel engine and in a breather pipe state, a breather pipe extends from an upper portion of the rear submarine body 13.

A control house is located in the submarine bow 4, navigation equipments and sonar equipments are also installed in the submarine bow 4, a periscope extends from an upper portion of the front submarine body 5.

A hydraulic oil tank 12, a fresh water tank, a diesel oil tank and a battery flat are provided under a main deck 23 of the telescopic submarine.

Immersion depth of the telescopic submarine when sailing on the water and lying inshore could be decreased via removing the first wedge-shaped keel 6 and the second wedge-shaped keel 16 and installing anti-rolling fins on the two sides of the front submarine body 5 and the rear submarine body 13.

In summary, advantages of the present invention are as following.

1. The telescopic submarine according to a preferred embodiment of the present invention has a single-skin pressure hull structure without a suction and drainage device. Compared to a submarine having a double-skin structure, the telescopic submarine is simple in structure and large in tank capacity.

2. Tasks of diving, surfacing and load adjustment could be finished via operating a controlling valve 10 and a hydraulic pump 11, therefore operations are simple.

3. The telescopic submarine according to a preferred embodiment of the present invention has a water-borne displacement and a submerged displacement equal to each other. There is no protruding tower, when the telescopic submarine is sailing under water, therefore a water resistance is low when sailing under the water, and a motility of the telescopic submarine is good.

Main uses of the present invention are as following.

1. The telescopic submarine could be used in tourist industry, to bring visitors the wonderful world under seawater.

2. The telescopic submarine could be used in personnel and small cargo transport. In a bad sea condition or in a hostile environment, the telescopic submarine is used to finish tasks of material supply and personnel transport to islands such as South China Sea Islands.

3. The telescopic submarine could be used in amphibious landing battle. In modern landing battle, an attacker must have advantages of sea, air, and space, and suffer heavy casualties to obtain a victory of the landing battle. The telescopic submarine is large in tank capacity, and is able to surface quietly without churning air billows and splashes. Therefore the telescopic submarine is able to carry a plurality of warriors at one time, get close to enemies reconditely, have a surprising effect and obtain the victory of the landing battle.

Figure 1:
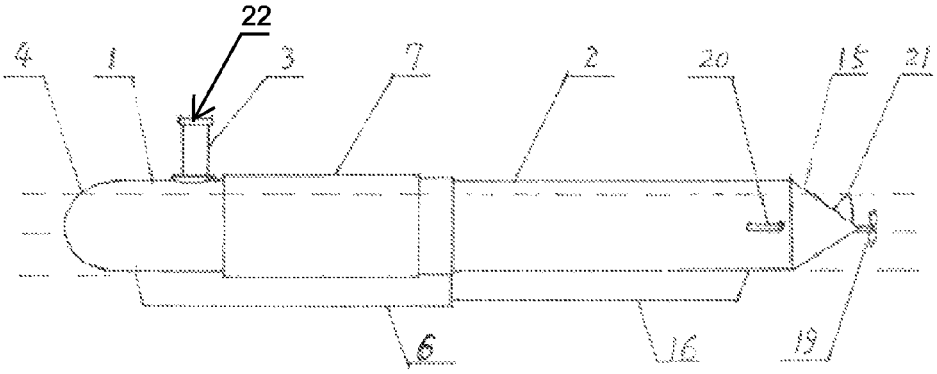
FIG. 1 is a sketch view of a telescopic submarine when the telescopic submarine is sailing on water.
Figure 2:
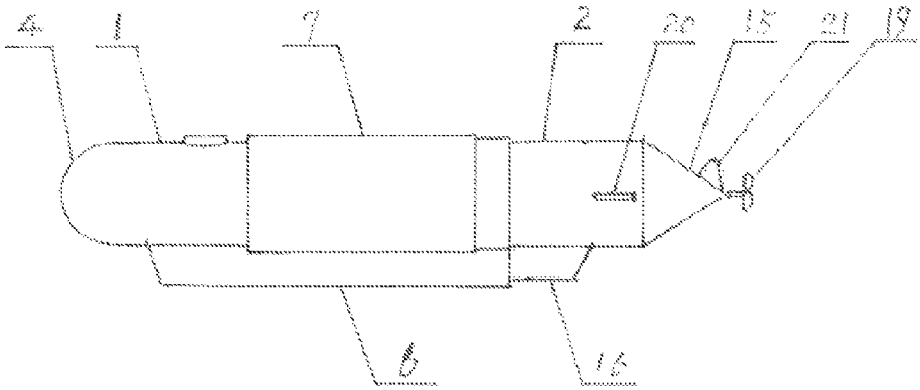
FIG. 2 is a sketch view of the telescopic submarine when the telescopic submarine is sailing under the water with no load.
Figure 3:
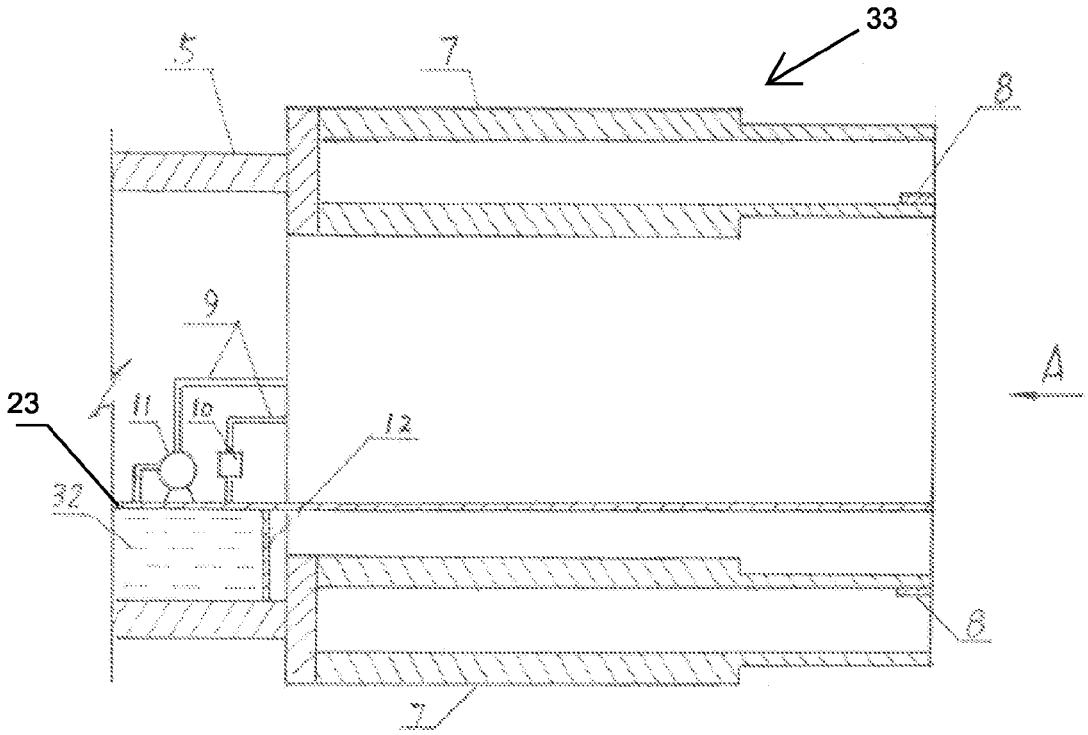
FIG. 3 is a longitudinal sectional view of the hydrocylinder.
Figure 4:
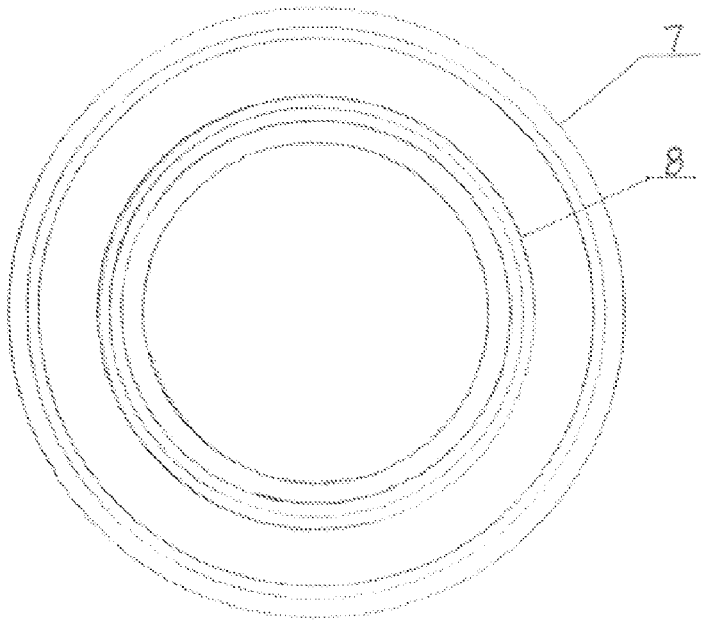
FIG. 4 is a sectional view of the hydrocylinder in a direction A shown in FIG. 3.
Figure 5:
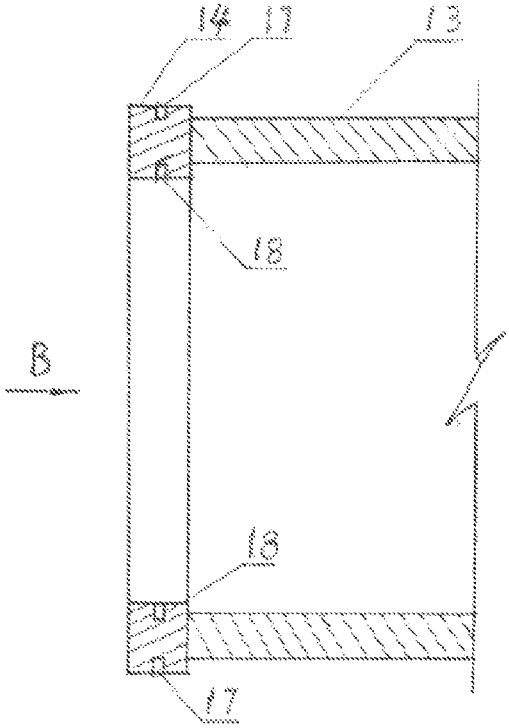
FIG. 5 is a longitudinal sectional view of a piston.
Figure 6:
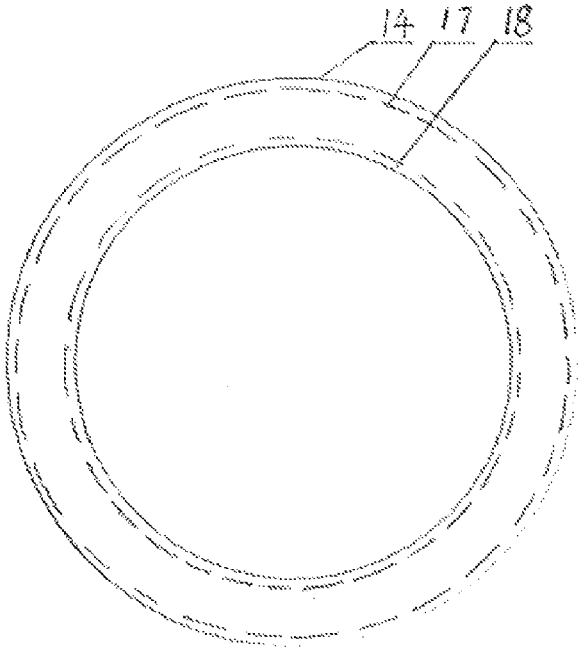
FIG. 6 is a sectional view of the piston in a direction B shown in FIG. 5.
Figure 7:
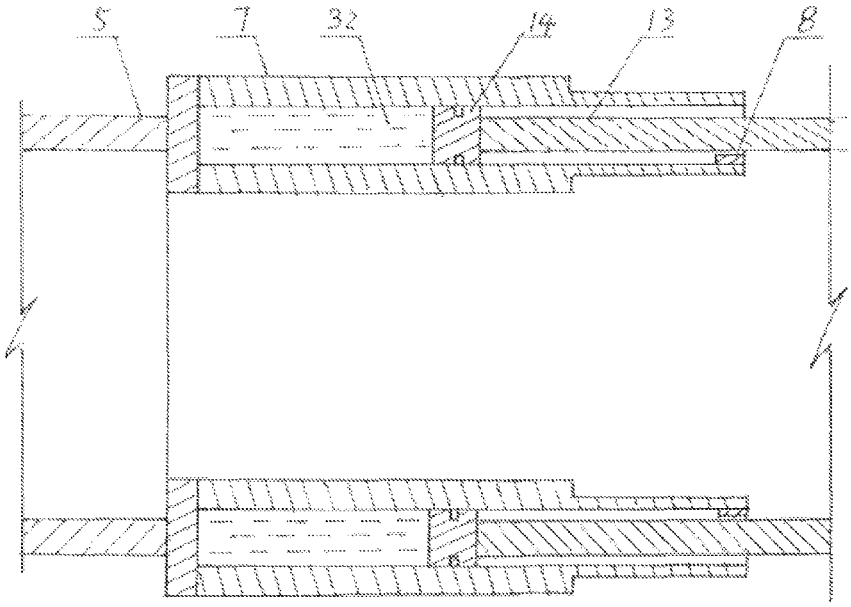
FIG. 7 is an assembly drawing of the hydrocylinder and the piston.

1—front submarine unit;
2—rear submarine unit;
3—lift tower;
4—submarine bow;
5—front submarine body;
6—first wedge-shaped keel;
7—hydrocylinder;
8—spacing ring;
9—pipeline;
10—controlling valve;
11—hydraulic pump;
12—hydraulic oil tank;
13—rear submarine body;
14—piston;
15—submarine stern;
16—second wedge-shaped keel;
17, 18—piston ring;
19—propeller;
20—horizontal rudder;
21—vertical rudder;
22—external thread sealing door;
23—main deck;
32—hydraulic oil;
33—stair

DETAILED DESCRIPTION OF THE PREFERRED EMBODIMENT

An electric-driven telescopic submarine has a maximum diving depth of 100 m (axle wire of submarine body), and has a submarine body in a shape of cylinder. The telescopic submarine has a diameter of 4 m. A front submarine body of the telescopic submarine has a length of 5 m, a hydrocylinder of the telescopic submarine has a length of 10 m, a rear submarine body of the telescopic submarine has a length of 15 m, a submarine bow has a length of 2 m, a submarine stem has a length of 3 m, and therefore the telescopic has a total length of 35 m. A lift tower is provided in a middle portion of the front submarine body, and the lift tower has a height of 2.1 m and a diameter of 1.6 m. When the telescopic submarine is sailing under water with no load, the rear submarine body has a portion of 10 m inserted into the hydrocylinder, and thus the total length is decreased to 25 m.

The telescopic submarine is made of X-80 steel plate which is 512 MPa in yield strength and is manufactured by China Shougang Corporation, wherein the steel plate of the submarine bow, the submarine stern, the front submarine body and the rear submarine body have a thickness of 20 mm, the steel plate of an outer cylinder of the ring-shaped hydrocylinder has a thickness of 44 mm, the steel plate of an inner cylinder has a thickness of 46 mm, a spacing between the inner cylinder and the outer cylinder is 120 mm, when the telescopic submarine is at the maximum diving depth, a pressure in the hydrocylinder is 8.33 MPa. The steel plate of the telescopic submarine has a total weight of 136.1 T, hydraulic oil in the telescopic submarine is 16 T in weight. With the lift tower, a series of rudders, wedge-shaped keels, etc. added, the telescopic submarine has a weight of 202 T. When the telescopic submarine is unloaded, a displacement of the telescopic submarine is 299.7 T, namely related equipments arranged in the telescopic submarine occupies 97.7 T of the displacement.

When the telescopic submarine is sailing under the water, a maximum load is 107 T, and a maximum tank capacity is 243 $m^3$. When the telescopic submarine is at the maximum load, a volume above the water is 18.8 $m^3$.

What is claimed is:

1. A telescopic submarine, comprising: a front submarine unit (1), a rear submarine unit (2), and a lift tower (3), wherein said front submarine unit (1) comprises a submarine bow (4), which is domed, a front submarine body (5), which is cylindrical, a first wedge-shaped keel (6) connected with a lower portion of said front submarine body (5), and a hydrocylinder (7), which is ring-shaped and connected with a rear end of said front submarine body (5), wherein a vertical section of said hydrocylinder (7) is in a shape of a stair (33), a spacing ring (8) is provided on an end portion of said hydrocylinder (7), said hydrocylinder (7) is connected with a controlling valve (10) and a hydraulic pump (11) via a pipeline (9), and said controlling valve (10) and said hydraulic pump (11) are respectively connected with a hydraulic oil tank (12), wherein said rear submarine unit (2) comprises a rear submarine body (13), which is cylindrical, a piston (14), which is ring-shaped and connected with a front end of said rear submarine body (13), a submarine stern (15), which is cone-shaped and connected with a rear end of said rear submarine body (13), and a second wedge-shaped keel (16) connected with a lower portion of said rear submarine body (13), wherein a cross-sectional area of said second wedge-shaped keel (16) is smaller than a cross-sectional area of said first wedge-shaped keel (6), a first piston ring (17) is embedded in an outer surface of said piston (14), a second piston ring (18) is embedded in an inner surface of said piston (14), said piston (14) and said hydrocylinder (7) operate with each other slidingly, a propeller (19), a horizontal rudder (20) and a vertical rudder (21) are installed in said submarine stern (15), and an external thread sealing door (22) is installed on a top portion of said lift tower (3).

2. The telescopic submarine, as recited in claim 1, wherein a plurality of watertight windows are respectively provided at two sides of said front submarine body (5) and said rear submarine body (13), and said watertight windows are made of laminated glasses.

3. The telescopic submarine, as recited in claim 1, wherein a hydraulic oil tank (12), a fresh water tank, a diesel oil tank and a battery flat are provided under a main deck (23) of said telescopic submarine.

4. A telescopic submarine, comprising: a front submarine unit (1), a rear submarine unit (2), and a lift tower (3), wherein said front submarine unit (1) comprises a submarine bow (4), which is domed, a front submarine body (5), which is cylindrical, and a hydrocylinder (7), which is ring-shaped and connected with a rear end of said front submarine body (5), wherein a vertical section of said hydrocylinder (7) is in a shape of a stair (33), a spacing ring (8) is provided on an end portion of said hydrocylinder (7), said hydrocylinder (7) is connected with a controlling valve (10) and a hydraulic pump (11) via a pipeline (9), and said controlling valve (10) and said hydraulic pump (11) are respectively connected with a hydraulic oil tank (12), wherein said rear submarine unit (2) comprises a rear submarine body (13), which is cylindrical, a piston (14), which is ring-shaped and connected with a front end of said rear submarine body (13), and a submarine stern (15), which is cone-shaped and connected with a rear end of said rear submarine body (13), a first piston ring (17) is embedded in an outer surface of said piston (14), a second piston ring (18) is embedded in an inner surface of said piston (14), said piston (14) and said hydrocylinder (7) operate with each other slidingly, a propeller (19), a horizontal rudder (20) and a vertical rudder (21) are installed in said submarine stern (15), and an external thread sealing door (22) is installed on a top portion of said lift tower (3), wherein anti-rolling fins are installed on two sides of said front submarine body (5) and said rear submarine body (13).

* * * * *